US012636563B2

(12) United States Patent
Halliburton

(10) Patent No.: US 12,636,563 B2
(45) Date of Patent: May 26, 2026

(54) BASKETBALL DRIBBLE TRAINING DEVICE AND METHODS

(71) Applicant: Ronald Halliburton, Loxahatchee, FL (US)

(72) Inventor: Ronald Halliburton, Loxahatchee, FL (US)

( * ) Notice: Subject to any disclaimer, the term of this patent is extended or adjusted under 35 U.S.C. 154(b) by 428 days.

(21) Appl. No.: 18/108,617

(22) Filed: Feb. 11, 2023

(65) Prior Publication Data

US 2024/0024750 A1 Jan. 25, 2024

Related U.S. Application Data

(60) Provisional application No. 63/309,081, filed on Feb. 11, 2022.

(51) Int. Cl.

| | |
|---|---|
| ***A63B 69/00*** | (2006.01) |
| ***A63B 63/00*** | (2006.01) |
| ***A63B 71/06*** | (2006.01) |
| *A63B 24/00* | (2006.01) |

(52) U.S. Cl.

CPC ..... *A63B 69/0071* (2013.01); *A63B 63/007* (2013.01); *A63B 71/0669* (2013.01); *A63B 2024/004* (2013.01); *A63B 2071/0625* (2013.01); *A63B 2220/833* (2013.01); *A63B 2225/74* (2020.08); *A63B 2243/0037* (2013.01)

(58) Field of Classification Search

CPC ..... A63B 69/0071; A63B 63/007; A63B 71/0669; A63B 2024/004; A63B 2071/0625; A63B 2220/833; A63B 2225/74; A63B 2243/0037; A63B 24/0059; A63B 24/0084; A63B 69/0053; A63B 69/0055; A63B 71/0622; A63B 2024/0037; A63B 2024/0068; A63B 2071/0675; A63B 2071/0694; A63B 2209/00; A63B 2220/17; A63B 2220/62; A63B 2220/801

USPC ..... 473/434, 435, 449, 448, 447, 454, 458, 473/455, 456, 476, 409

See application file for complete search history.

(56) References Cited

U.S. PATENT DOCUMENTS

| | | | | |
|---|---|---|---|---|
| 5,971,761 | A * | 10/1999 | Tillman, Sr. | G09B 19/00 434/167 |
| 6,692,385 | B2 * | 2/2004 | Walker, Jr. | A63B 69/0071 473/447 |
| 6,743,971 | B1 * | 6/2004 | Chen | G10H 1/32 84/746 |
| 7,870,625 | B2 * | 1/2011 | Omar | A47D 15/003 5/655 |
| 8,002,283 | B1 * | 8/2011 | Jones | F41J 5/06 273/354 |
| 9,691,240 | B2 * | 6/2017 | Bradford | G08B 13/10 |

(Continued)

*Primary Examiner* — Nini F Legesse

(74) *Attorney, Agent, or Firm* — Andrew C. Attken

(57) ABSTRACT

A practice aid for dribbling a basketball is disclosed that includes a flat panel and at least one target sensor, an accelerometer, a controller and a display wherein the target sensor detected that impact of a ball on a target and sends a signal to a controller, a accelerometer that detects all impacts of balls on the panel and sends a signal to the controller. and the controller sends a signal to the display that tracks the number of hits of the target and the number of attempts, and displays a score, and the controller also sends a signals to activate and deactivate the target sensor, and accelerometer, and the controller further controls a countdown timer on the display.

9 Claims, 11 Drawing Sheets

(56) References Cited

U.S. PATENT DOCUMENTS

| | | | | |
|---|---|---|---|---|
| 9,814,936 | B1 * | 11/2017 | Bucolo | A63B 71/0622 |
| 2011/0195392 | A1 * | 8/2011 | Kim | G09B 19/00 434/365 |
| 2016/0206945 | A1 * | 7/2016 | Nusbaum | A63B 69/3614 |
| 2021/0236903 | A1 * | 8/2021 | Briel | A63B 71/0622 |
| 2022/0096911 | A1 * | 3/2022 | Keyhani | A63B 71/0622 |

* cited by examiner ( Top Acrylic Layer )

BASKETBALL DRIBBLE TRAINING DEVICE AND METHODS

CROSS REFERENCE TO RELATED APPLICATIONS

The Applicant claims the benefit of the filing date of U.S. Application No. 63/309,081, filed Feb. 11, 2022.

FIELD OF THE INVENTION

The present invention is directed to a device useful for training basketball players' dribbling skills and is also useful for contests and games relating to dribbling.

SUMMARY OF THE INVENTION

The invention disclosed is directed to a basketball training or amusement device that includes a flat panel having at least one target that is provided with a sensor configured to detect a ball that impinges on the target, a controller and a display to provide game information. The display includes a countdown timer, a display field that tracks the number of times that ball hits the target in a designated time period, and a player identity display field. Embodiments of the invention use input switches to initiate play. In embodiments, the device also detects each time a ball hits the device and. as such, a controller can determine the number of consecutive hits of the target and can compare the number of hits to the total number of time the ball impacts with the device and thereby assess the relative accuracy of the player over a predesignated time period. In other embodiments feedback is also provided in the form of visual signals from lights and audio signals from loudspeakers that are programmed to activate in repone to predetermined criteria. For example, after a predetermined number of consecutive hits, a light display and the loudspeaker are activated.

In further embodiment the device is configured to provide a bonus time if a predefined number of successful hits are detected in sequence, or a player reaches a threshold point level. In other embodiments, the point value of the hit is increased during a defined time period near the end of the timed period for play. In yet other embodiments, a plurality of targets are provided and the game can be designed so the object of the game is to hit different targets in different sequences.

DETAILED DESCRIPTION

Figure 1:
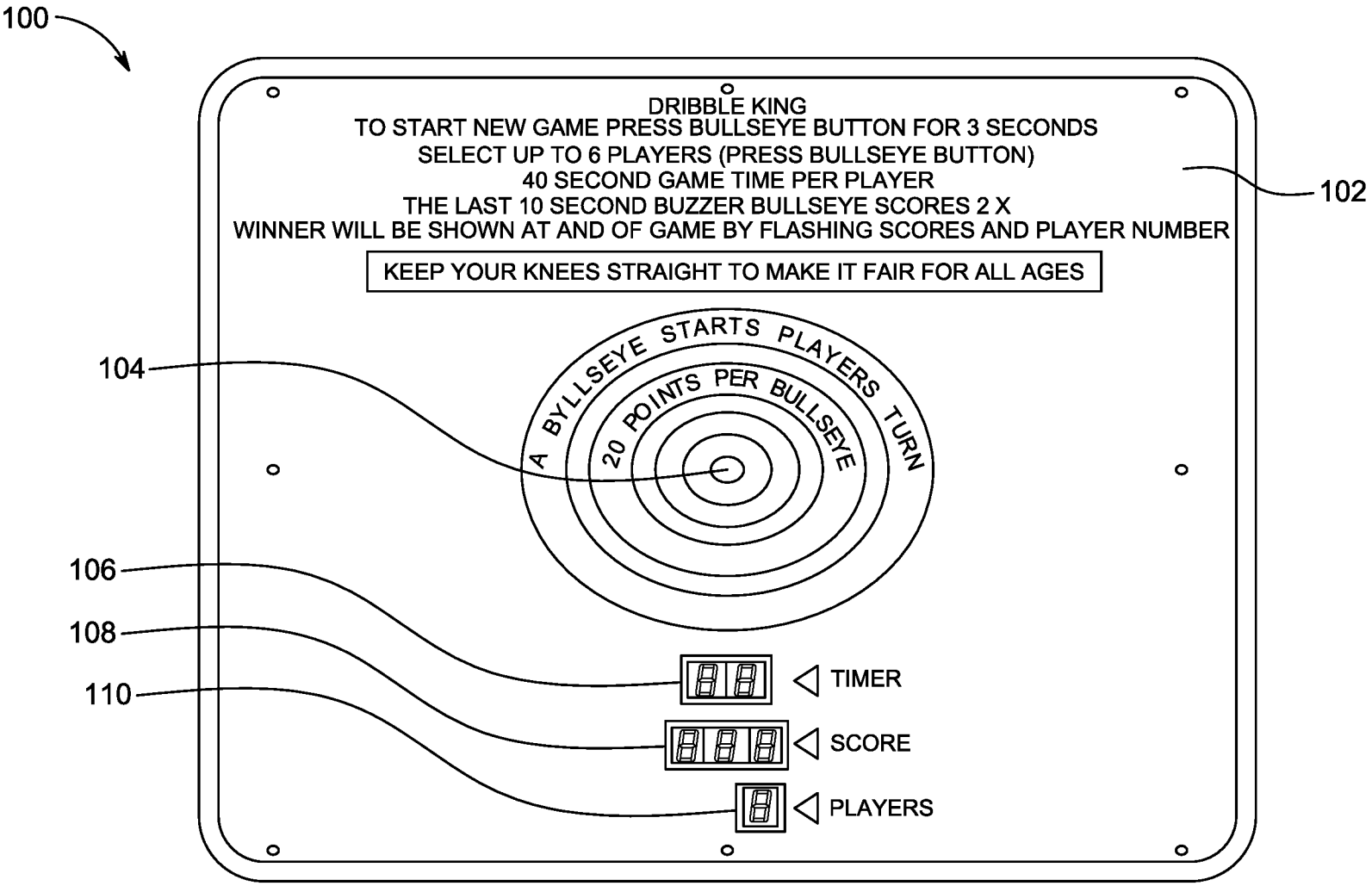
FIG. 1 is a top plan view of a first embodiment of the invention.

Referring now to FIG. 1, training device 100 is a flat panel part that has a flat top surface 102 on which a bullseye target provided thereon that has a central switch actuator 104 that extends slightly above top surface 102. In the embodiment depicted the panel 100 is a square but in other contemplated embodiments the panel is round or a quadrilateral. The panel is made from materials with sufficient hardness to allow a ball to bounce off the surface such as wood or a synthetic resin such as acrylic or various combinations of the same. The switch actuator 104 that is provided has a flat target part that slightly extends past the top surface 102 and is responsive to pressure. Device 100 device has a flat bottom surface that allows it to be laid on a support surface, such as floor, and will not tilt or wobble. In a first embodiment the switch actuator 104 is located at the center or bullseye target 102 that has a series of concentric rings which is easily recognized as target. In an embodiment switch actuator 104 is a portion of an electro-mechanical switch that uses a spring to urge the actuator back to a home position, slightly above the top surface 102 of the playfield. Pushing the actuator downward causes a circuit to be completed and a signal is transmitted to a controller. The playfield is also provided with a series of windows that reveal displays for a countdown timer 106, a score 108 and player identity indicator 110. In embodiments, the device is provided with further display lights to provide signals to the player (1) when the game is ready for play, (2) when the target has been successfully hit, (3) when the target has been hit a predetermined number of times sequentially or in a row, (4) when the play is coming to an end, and (5) when play is over. Signals to the player may be communicated by sequentially illuminating lights, flashing lights and the use of different color lights to represent different game conditions.

In a first embodiment, the game includes a switch that can be manipulated to select the initiation of new game play and the selection of the number of players. In embodiments, the switch is the central actuator wherein the central actuator is pressed for three seconds to start a new game. Next the number of players is selected by pushing the activator until the desired number is displayed. After a pause, the first player number 1 is illuminated indicating it is time for player 1 to initiate play. Next the countdown time is activated, and play is initiated. When the countdown timer ends, signals from the switch are not recognized and a final score for player 1 is displayed. After a predetermined time, the player indicator displays a 2 for the second player and the process repeats to resume pay. In alternative embodiments, a power switch and selection switches may be provided that provide input to a central controller.

Figure 2:
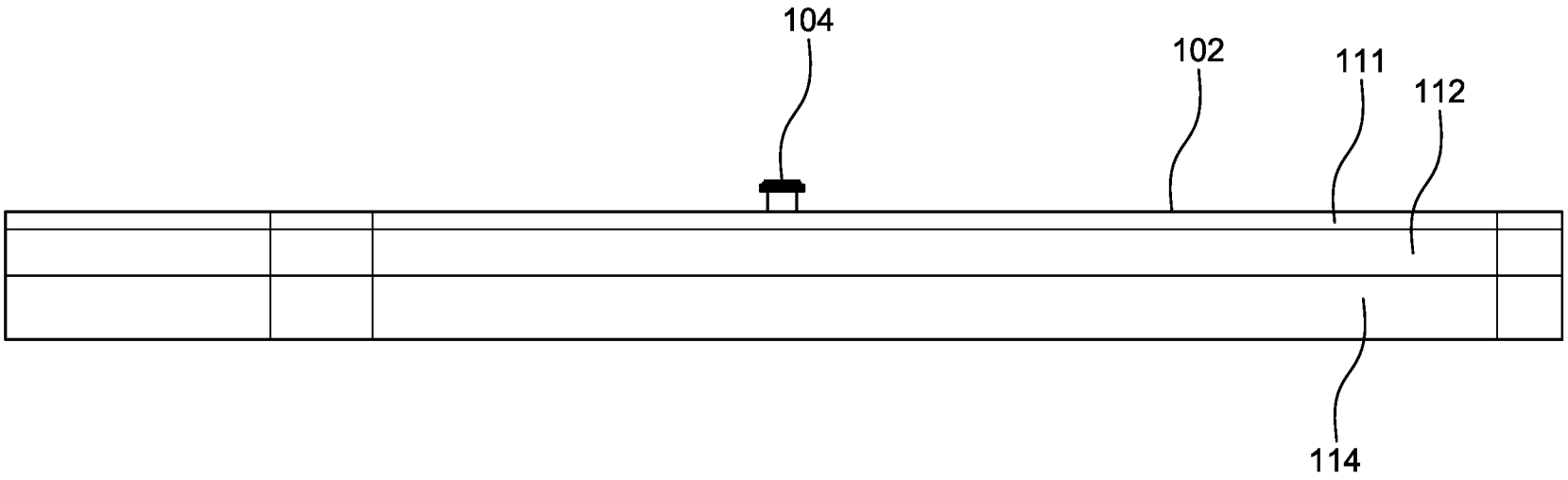
FIG. 2 is a side view in elevation of the embodiment of FIG. 1.
Figure 3:
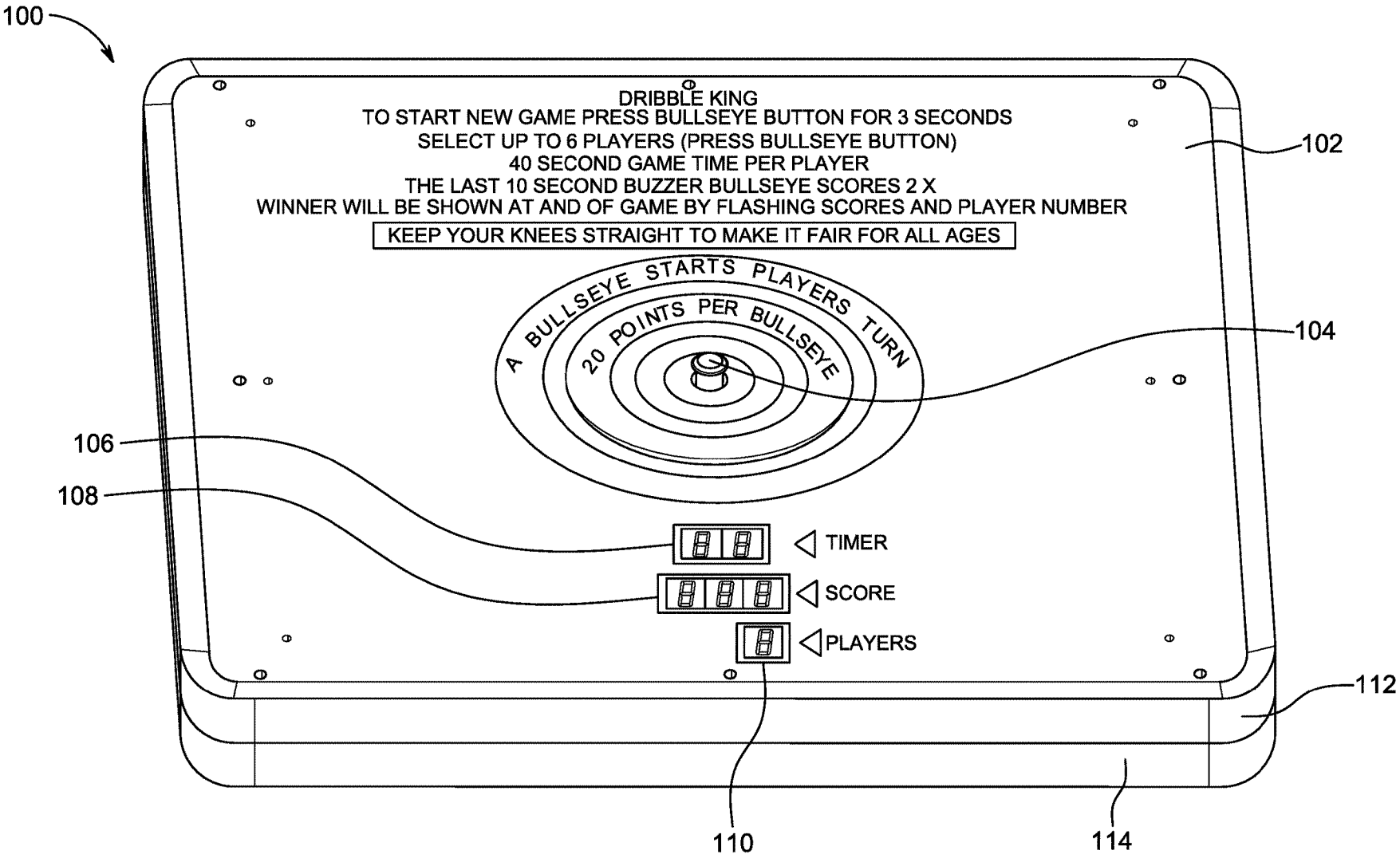
FIG. 3 is a perspective view of the embodiment of FIG. 1.

Now referring to FIG. 2, a side view of the device 201 is made from three layers, a bottom layer 114, a core layer 112 and a top layer 110 that includes top surface 104. The top flange 211 of an actuator on switch 104 is shown elevated above the top surface 102. FIG. 3 is a perspective view that also shows the actuator 104 extending perpendicular from the top surface 102 of the device. In this view the bottom layer 114, core layer 113 and top layer are also shown.

Figure 4:
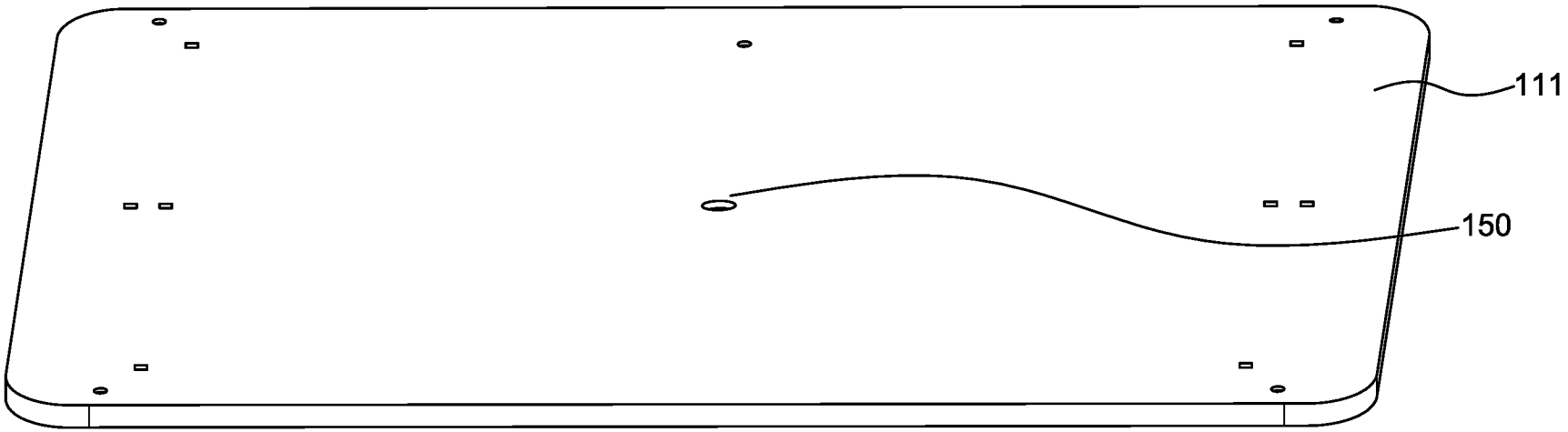
FIG. 4 is a perspective view of the top layer the embodiment of FIG. 1.
Figure 5:
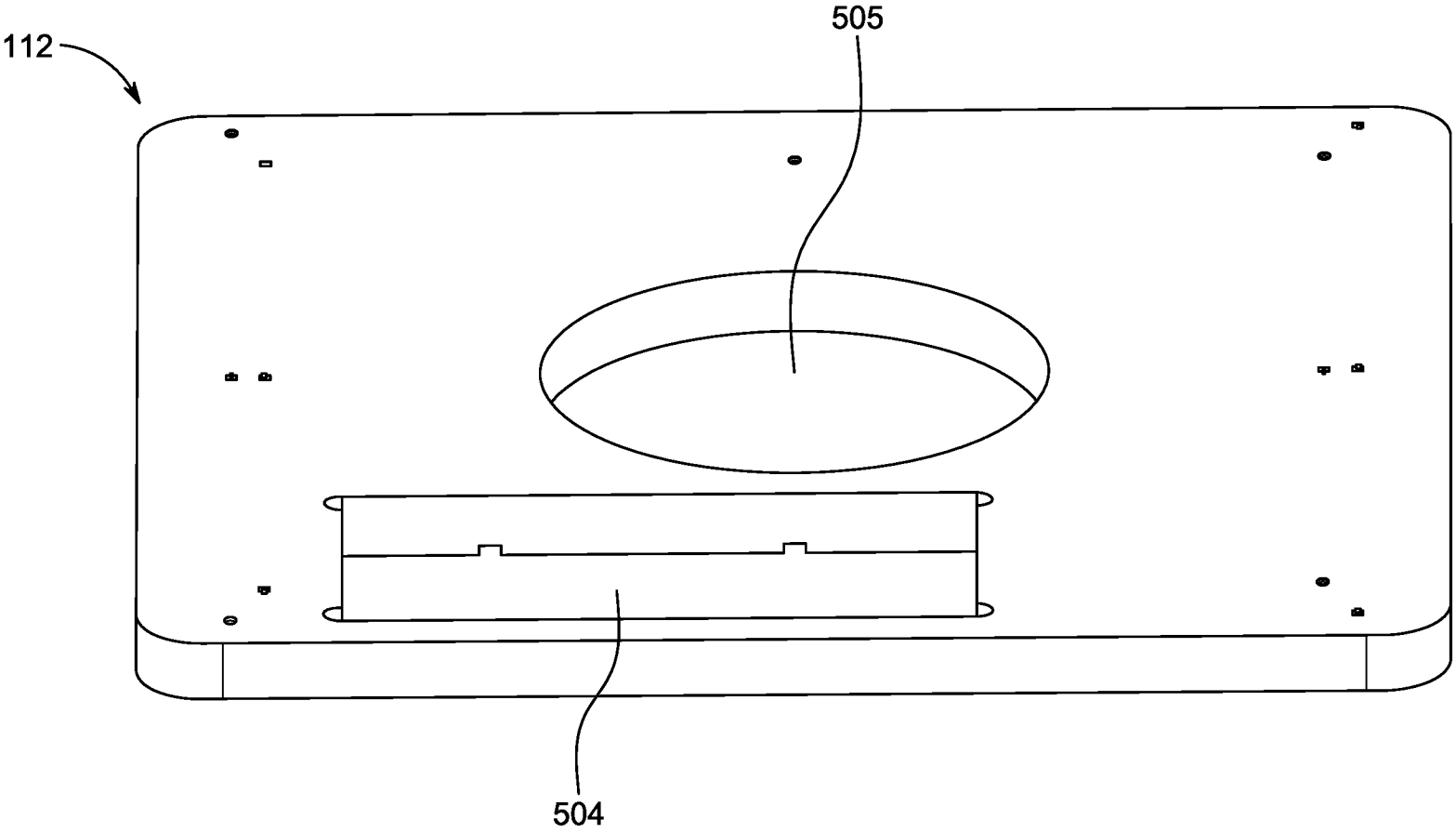
FIG. 5 is a perspective view of a core layer or section of an embodiment of the invention.
Figure 6:
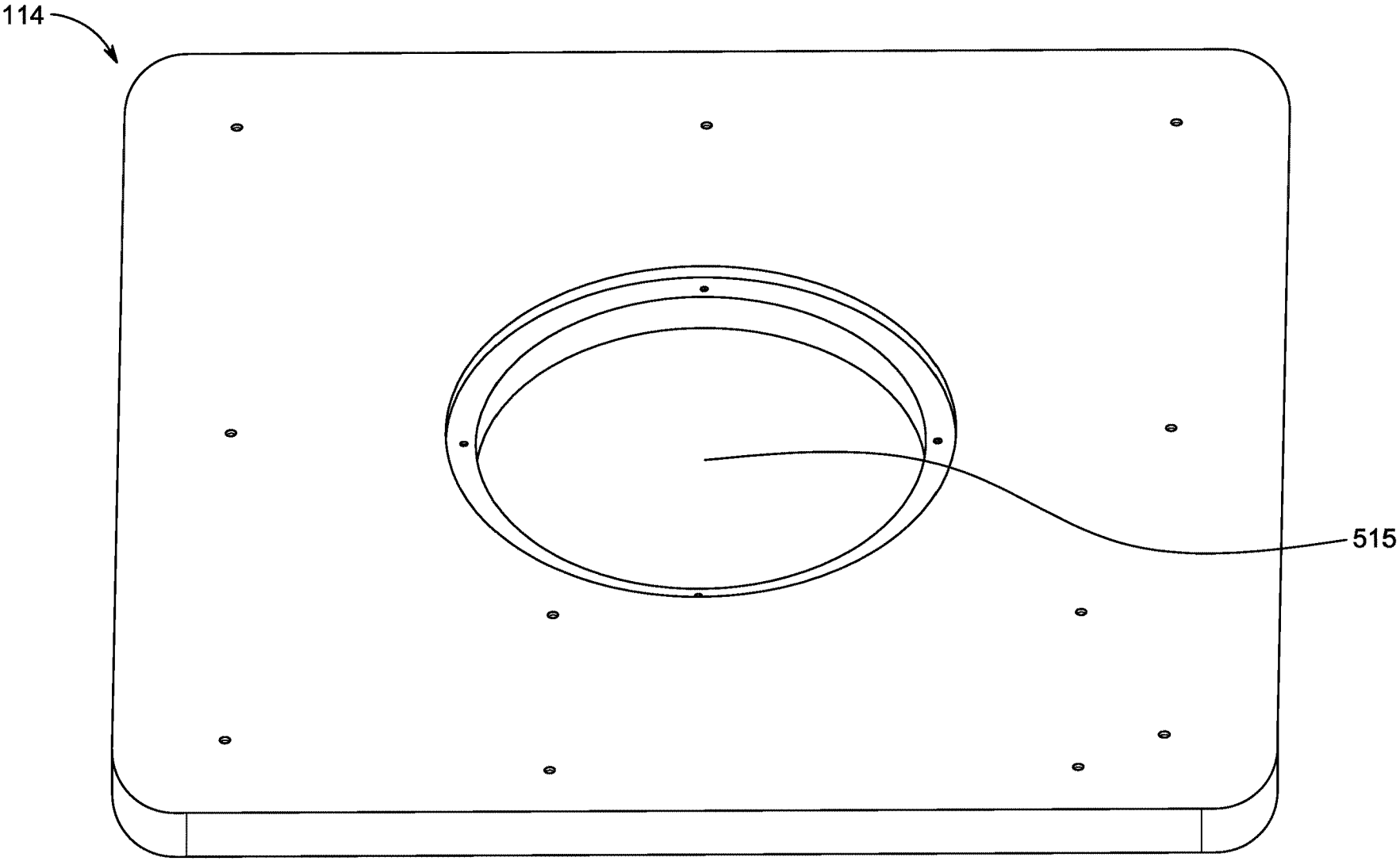
FIG. 6 is a is a perspective view of the lower layer of the device.
Figure 7:
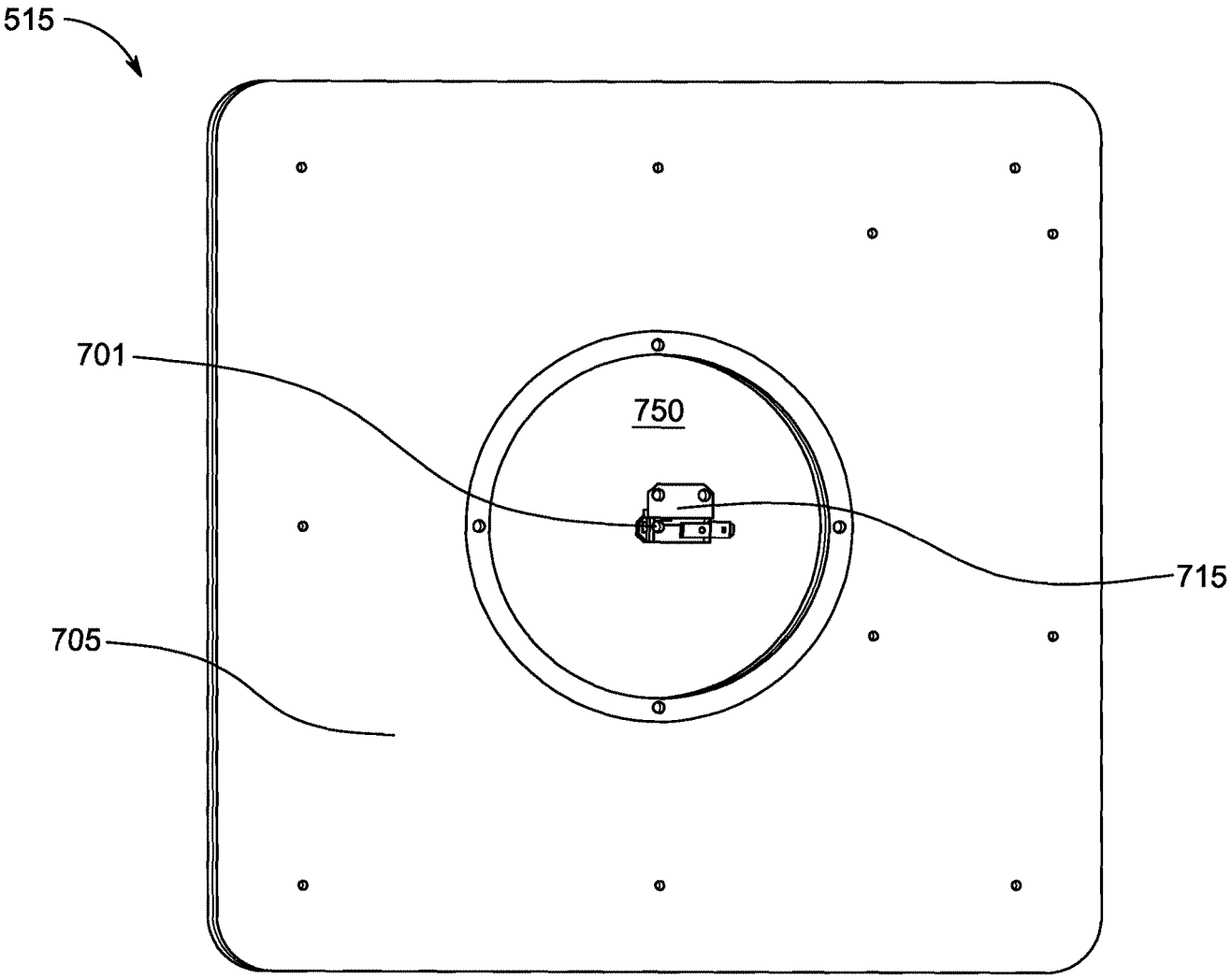
FIG. 7 is a bottom view of the device showing the detector associated with the target.

FIG. 4 depicts the top layer 11, which preferably made from transparent acrylic, and which receives a sticker on its top surface on which is printed instructions for game play. Indicia on the sticker also identify the score board features. Portions of the sticker are also transparent to allow the user to view the displays that are provided in the core layer. The top layer has a central aperture 150 through which an actuator, or actuator stem may pass. The device is also provided with pilot holes that receive fasteners (not shown) that serve to attach the top layer 111 to the core layer 112. The top member is attached to the core member with fasteners, adhesive or both. The core layer 112 is depicted in FIG. 5 and is characterized by a round central cavity 505 that receives a micro switch and a rectangular cavity 504 that receives a display and its associated electronics. In the embodiment depicted core layer may be made from synthetic resin but other materials such as composite wood, plywood, hardwood or a material with similar hardness properties may be used for this component, The base layer or lower layer 114 is depicted in FIG. 6 which is made of the same of similar material as middle core layer 112. Lower layer 114 has a round cavity 515 that can be aligned with the cavity of the core member and is designed to receive a micro switch. As best seen in FIG. 7, a view of the bottom of the device 715, a micro switch 701 is positioned within center cavity and retained in place by bracket 715 that is attached to switch 701 and the bottom surface 750 of upper layer 111.

Figure 8:
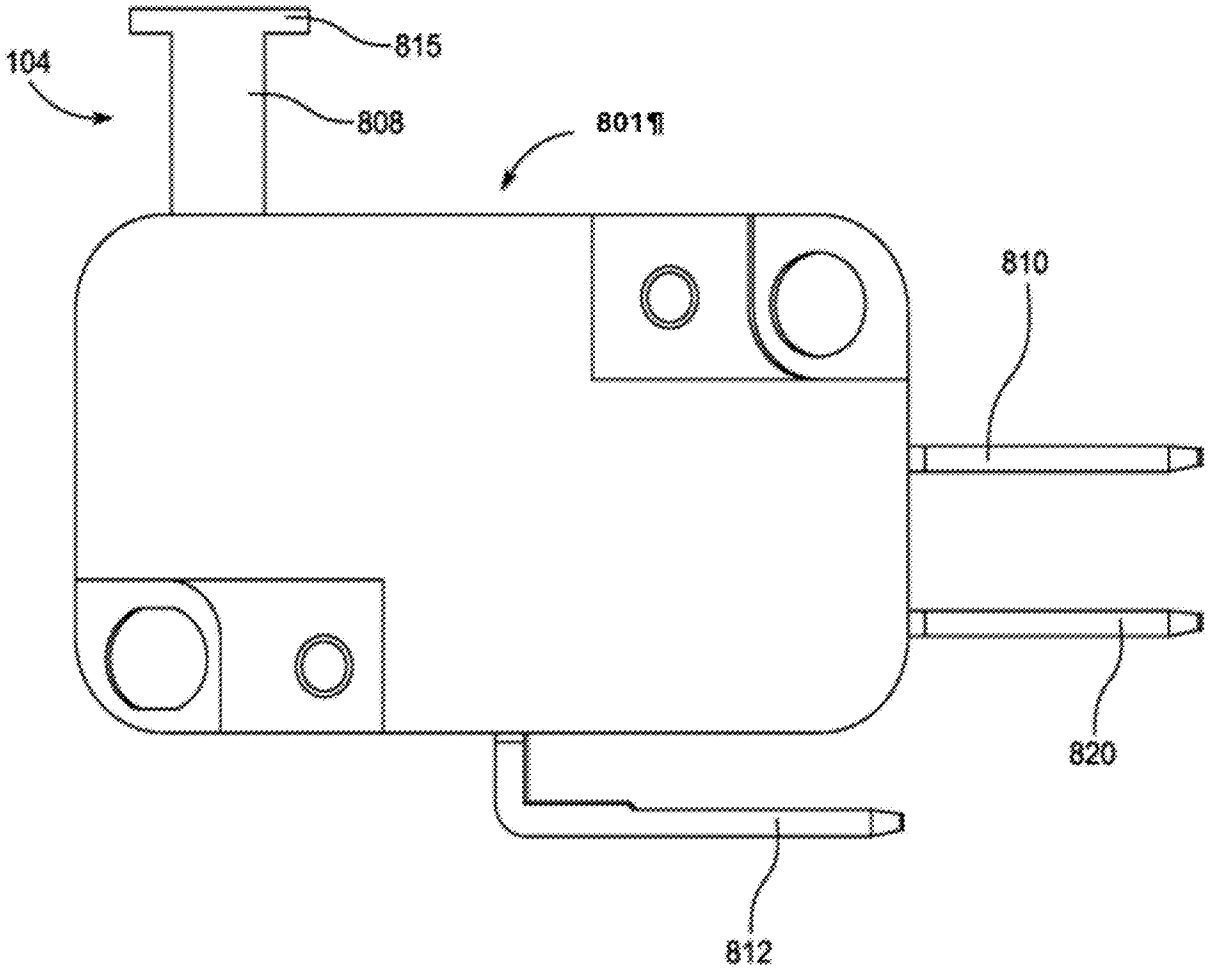
FIG. 8 is a plan view of a detector used with embodiments of the invention.
Figure 9:
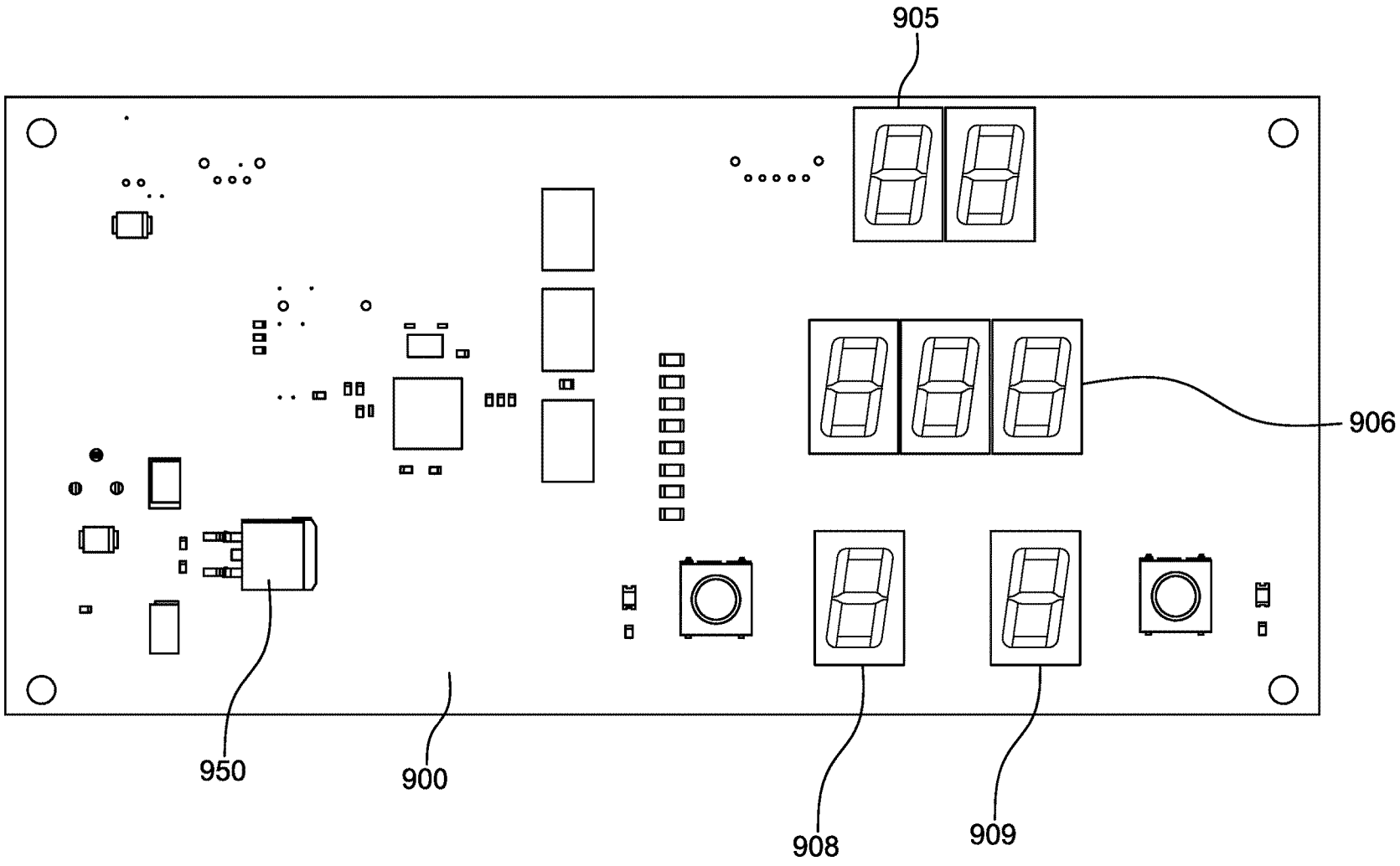
FIG. 9 is a top plan view of an electronics board used with embodiment of the invention that includes displays and a controller.

FIG. 8 depicts micro switch 801 that has a spring biased push button actuator 104 manufactured by Zippy. The actuator 104 is modified with a stem section 808 and flange 815. Extending from the switch is prong 810 that supplies power to the switch, prong 812 for ground and prong 820 that sends a signal to the controller. FIG. 9 depicts the electronics board 900 in an embodiment of the invention with two player displays, 908 and 908. Board 900 also includes controller 950, countdown timer display 905 and score display 906.

Figure 10:
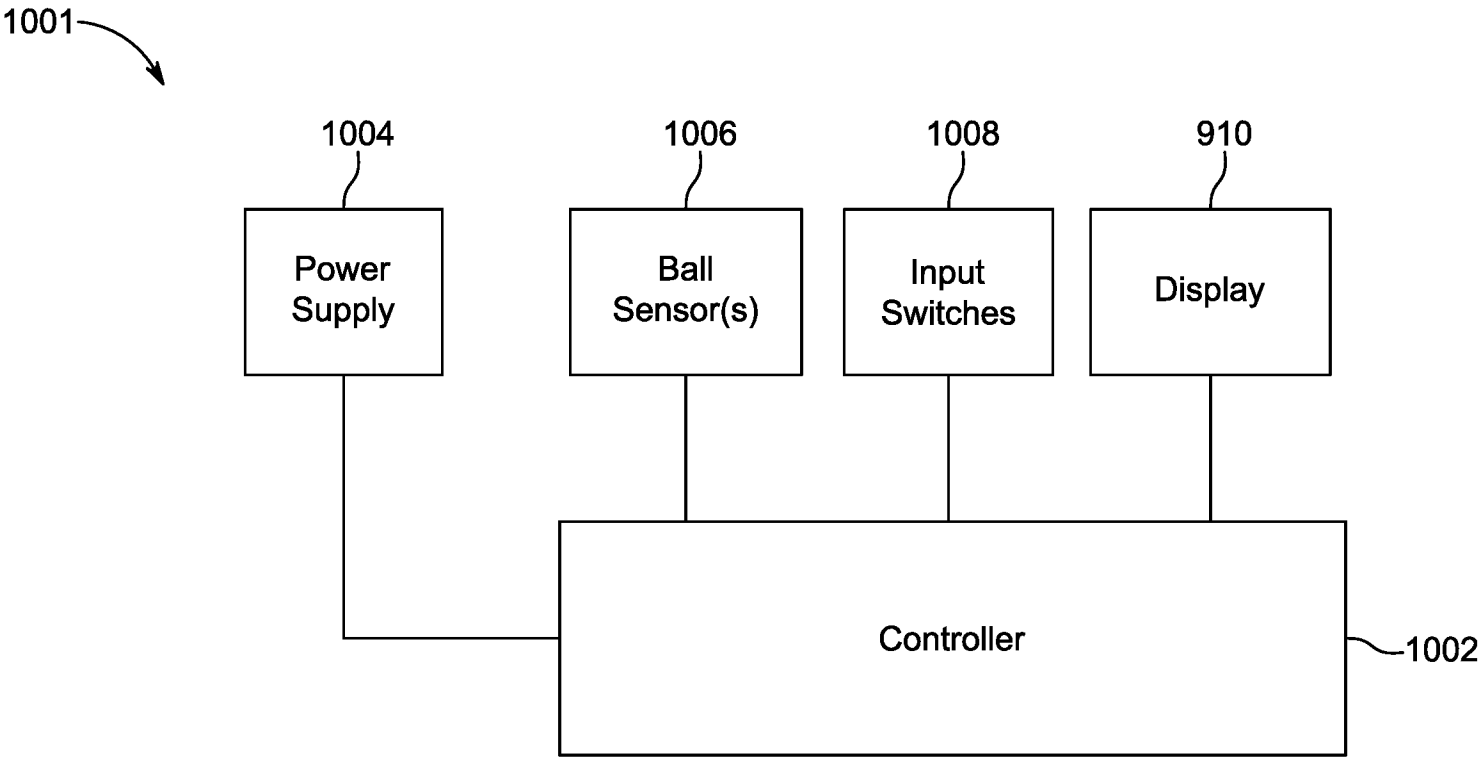
FIG. 10 is a schematic figure of the controller and associated inputs and outputs.
Figure 11:
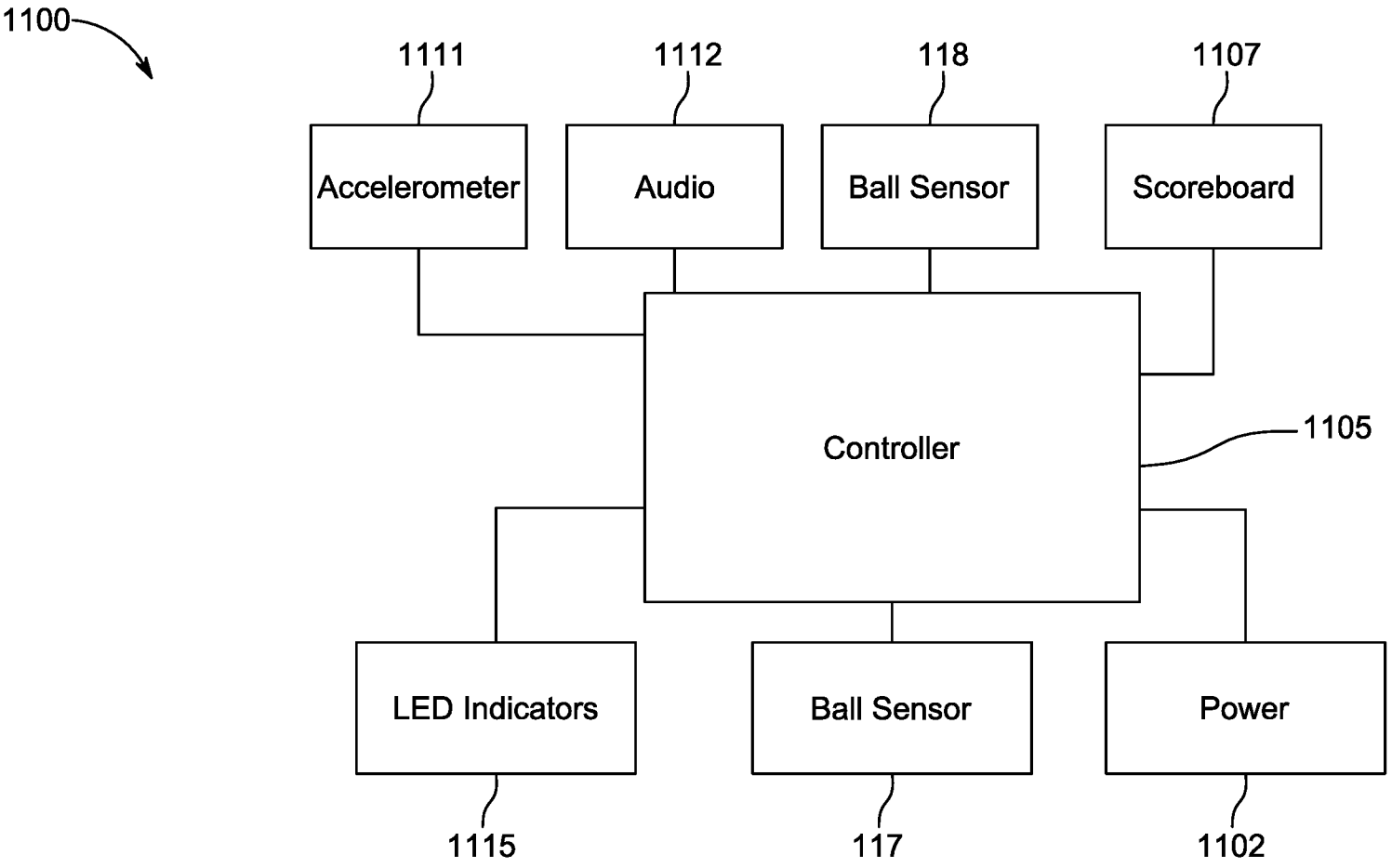
FIG. 11 is a second schematic figure of the controller and associated inputs and outputs.

FIG. 10 depicts a schematic illustration of the electronics of an embodiment 1001 that includes a power supply 1004, a controller 1002 which receives input from ball sensor 1006. Controller 1002 provides output to a display 910 to provide information relating to the game timer, the score board display and the player display. An alternative embodiment is depicted in FIG. 11 that includes an accelerometer 1111 or impact sensor that provides signals to controller 1105. In this embodiment, the device is able to sense each time a ball drops onto the device and therefore measures both when the ball impacts the target and impacts to the panel that have missed the target. This embodiment has a loudspeaker 112 that is programmed to provide audio signals relating to game play and LED Indicators 1115 to provide visual feedback to the player which includes flashing lights to indicate which targets are active, flashing lights to signal a bonus condition, flashing lights to indicate the time for game play is close to elapsing, lights to signal the accomplishment of a goal or score, such as successfully hitting the designated target a predetermined number of times, exceeding a high or highest score, or scoring higher than a second player. The embodiment of FIG. 11 also depicts two ball sensors, 118 and 117 each which is associated with a different target. This arrangement allows a player to move a bouncing ball back and forth between two targets. In an alternative arrangement an indicator light is illuminated next to the active target in a seemingly random pattern or unpredictable pattern to test the reaction time of the player. In this game sequence, a player tries to dribble to hit the target that is illuminated by a LED light provided near the target and this illumination may change after each successful or unsuccessful bounce. If the target is missed, the accelerometer will register a bounce that is not correlated with a target hit. One ordinarily skilled in the art can program the audio loudspeaker and visual led display to provide different feedback that depends on the game play result, that may make gameplay more enjoyable. As described herein, a device is provided that can improve the dribbling skills of basketball players. The device allows for multiplayer play and allows for different game play scoring including measuring the most successful hits over a predetermined time, measuring the most successful hits in a row, measuring the best average of hits to misses over time, measuring the accuracy of the play over time by comparing the number of total bounces with the number of total hits and calculating an average.

In yet further embodiments, additional targets and target sensors are provided on the panel and a player can attempt to dribble the ball in predetermined sequences or attempt to dribble to targets designated by an indicator light. Like previous embodiments, the sensor and accelerator can detect successful and unsuccessful attempts and provide a score.

All descriptions, embodiments, illustrations, depictions, drawings, features, and additional features made herein are for the purpose of revealing the invention and are not intended to and should not limit the scope and application of the invention. It is to be understood, however, that even though numerous characteristics and advantages of the embodiment have been set forth in the foregoing description, together with details of the structure and function of the embodiment, the disclosure is illustrative only, and changes may be made in detail, especially in the matters of shape, size, and arrangement of parts within the principles of the present disclosure to the full extent indicated by the broad general meaning of the terms in which the appended claims are expressed.

I claim:

1. An amusement device comprising a panel, said panel comprising a front side and rear side, said rear side adapted to be positioned on a horizonal surface so that said front side is oriented in a horizontal plane, and said panel has at least one target on said front side and said front side comprising a flat surface, wherein said target comprises a pressure sensitive switch having a switch actuator that projects from said front side of said panel and can detect the physical impact of an object that contacts said switch actuator, and said switch actuator having a stem extending from a body of said switch and a flange on the terminal end of said stem, and said flange has a flat top surface that is parallel with said flat surface of said front side, and a controller, said controller in communication with said switch and receives input signals from said switch and said controller processes said signals and transmits output signals to a display, said output signals containing data comprising the number of impacts on said switch actuator and reflecting a score.

2. The amusement device recited in claim 1 further comprising a countdown timer and a display region for the display of said score and wherein said controller is configured to activate said countdown timer and upon activation receive signals from said switch during a predetermined time, and transmits signals to said display reflecting the number of time the actuator of said switch has been impacted.

3. A method of playing a game using the device described in claim 2 comprising the steps of activating said countdown timer that provides a game time period for a predetermined time, dribbling a ball on said panel during said predetermined time, wherein each time a ball impacts said switch actuator, a signal is transmitted to said controller and said controller increments a score on a score display.

4. A method of playing a game on the device recited in claim 2 comprising the steps of activating said countdown timer that provides a game time period for a predetermined time and displaying the countdown timer that counts down from a predetermined time, dribbling a ball on said panel during said predetermined time, wherein when each time a ball impacts said actuator switch, a signal is transmitted to said controller and said controller increments a score on a score display, and wherein when each time a ball impacts said panel said accelerometer transmits a signal to said controller and, at the end of said predetermined time, said controller calculates a score comprising the percentage that reflects the number of impacts to the switch actuator in said predetermined period to the number of impacts to the panel in said predetermined period and displays said percentage calculation on a display.

5. The amusement device recited in claim 1 wherein said panel further comprises a panel impact sensor, wherein said panel impact sensor detects the impact of an object anywhere on said panel and said panel impact sensor comprises and accelerometer and said accelerometer to send a signal to said controller each time said panel is impacted by an object.

6. The amusement device recited in claim 1 further comprising a plurality of target locations and each said target location comprising a switch actuator and switch that communicates with said controller.

7. The amusement device recited in claim 1 wherein said switch is an electromechanical switch.

8. The device recited in claim 1 wherein said switch comprises an optical sensor and wherein in response to an object impacting said target, a part of said switch actuator is displaced from a light path between a light source and a light detector thereby generating a signal from on a light detector that is transmitted to said controller.

9. The device recited in claim 1 further comprising a light display and a loudspeaker, wherein said light display and said loudspeaker are activated by said controller in response to predetermined input signals from said switch.

* * * * *